US010605130B2

(12) United States Patent
Anjevik et al.

(10) Patent No.: US 10,605,130 B2
(45) Date of Patent: Mar. 31, 2020

(54) VALVE SEAT INSERT

(71) Applicant: VOLVO TRUCK CORPORATION, Göteborg (SE)

(72) Inventors: Alexander Anjevik, Torslanda (SE); Henrik Karlsson, Hisings Backa (SE)

(73) Assignee: VOLVO TRUCK CORPORATION, Göteborg (SE)

( * ) Notice: Subject to any disclaimer, the term of this patent is extended or adjusted under 35 U.S.C. 154(b) by 221 days.

(21) Appl. No.: 15/567,785

(22) PCT Filed: May 6, 2015

(86) PCT No.: PCT/EP2015/059967

§ 371 (c)(1),
(2) Date: Oct. 19, 2017

(87) PCT Pub. No.: WO2016/177419

PCT Pub. Date: Nov. 10, 2016

(65) Prior Publication Data

US 2018/0163579 A1 Jun. 14, 2018

(51) Int. Cl.

| | |
|---|---|
| ***F01L 3/02*** | (2006.01) |
| ***B22F 3/00*** | (2006.01) |
| ***B22F 3/10*** | (2006.01) |
| ***B22F 3/15*** | (2006.01) |
| ***B22F 5/00*** | (2006.01) |
| *F02F 7/00* | (2006.01) |

(52) U.S. Cl.

CPC ..... *F01L 3/02* (2013.01); *B22F 3/1007* (2013.01); *B22F 3/15* (2013.01); *B22F 5/008* (2013.01); *B22F 2201/11* (2013.01); *B22F 2201/20* (2013.01); *B22F 2301/35* (2013.01); *F02F 7/0085* (2013.01)

(58) Field of Classification Search

CPC ..... B22F 3/1007; B22F 3/15; B22F 5/008; F01L 3/02; F01L 3/04; F01L 2101/00

See application file for complete search history.

(56) References Cited

U.S. PATENT DOCUMENTS

| | | | |
|---|---|---|---|
| 5,934,238 A | 8/1999 | Wang et al. | |
| 2002/0006859 A1 | 1/2002 | Wotting et al. | |
| 2003/0233910 A1 | 12/2003 | Jeong et al. | |
| 2008/0053574 A1 | 3/2008 | Sandberg et al. | |
| 2010/0190025 A1 | 7/2010 | Farthing et al. | |
| 2011/0162612 A1* | 7/2011 | Qiao | C22C 1/02 123/188.3 |

FOREIGN PATENT DOCUMENTS

| | | |
|---|---|---|
| CN | 102220454 A | 10/2011 |
| EP | 2082119 B1 | 7/2009 |
| JP | S62191607 A | 8/1987 |
| JP | H04157138 A | 5/1992 |

OTHER PUBLICATIONS

International Search Report (dated Jan. 22, 2016) for corresponding International App. PCT/EP2015/059967.

* cited by examiner

*Primary Examiner* — Jacob M Amick

(74) *Attorney, Agent, or Firm* — Venable LLP; Jeffri A. Kaminski

(57) ABSTRACT

A valve seat insert for an internal combustion engine has a first portion that is adapted to contact a cylinder head and a second portion that is adapted to contact a valve. The valve seat insert has a valve seat insert volume. A major part of the valve seat insert volume includes a homogeneous material that includes nitrides.

20 Claims, 6 Drawing Sheets

VALVE SEAT INSERT

BACKGROUND AND SUMMARY

The present disclosure relates to a valve seat insert. Moreover, the present disclosure relates to a method for manufacturing a valve seat insert.

An internal combustion engine generally comprises a plurality of valves, each one of which selectively provides a fluid communication between a combustion chamber and another portion of the internal combustion engine, e.g. an intake assembly or an exhaust assembly.

A valve is generally adapted to abut a valve seat when in a closed position. The valve seat may for instance be an integral portion of a cylinder head or a separate component that is connected to the cylinder head. Such a separate component may be referred to as a valve seat insert.

U.S. Pat. No. 5,934,238 discloses a valve seat insert that comprises a layer consisting essentially of nitride for reducing adhesive and abrasive wear during use. However, there is still a need for improving internal combustion engine valve seat inserts.

It is desirable to provide a valve seat insert that has an appropriate endurance.

As such, the present disclosure relates to a valve seat insert for an internal combustion engine. A first portion of the valve seat insert is adapted to contact a cylinder head and a second portion of the valve seat insert is adapted to contact a valve. The valve seat insert has a valve seat insert volume, i.e. the entire volume of the material constituting the valve seat insert.

According to the present disclosure, a major part of the valve seat insert volume, i.e., more than 50% thereof, consists of a homogeneous material that comprises nitrides.

The valve seat insert according to the above implies a preferred endurance since a large portion of the valve seat insert volume has desired endurance properties by virtue of the presence of nitrides. Moreover, the valve seat according to the above implies that the valve seat, insert, and possibly also the cylinder head, may be machined after the valve seat insert has been inserted into the cylinder head.

As used herein, the expression "nitrides" relates to a composition of the type MN, where "M" stands for a metallic component and "N" for nitrogen. For instance, the nitrogen may have a formal oxidation state of −3.

Optionally, at least 80 vol %, alternatively at least 90 vol %, preferably least 95 vol %, more preferred at least 98 vol % of the valve seat insert consists of the homogeneous material. A homogeneous material amount at or above any one of the above limits implies an improved durability.

Optionally, the homogeneous material comprises at least 5 vol %, preferably at least 10 vol %, more preferred at least 15 vol %, of nitrides. A nitride amount at or above any one of the above limits implies an appropriately low friction and/or low risk of galling during use.

Optionally, the homogeneous material comprises at least 3 vol % of carbides. A carbide amount at or above any one of the above limit implies an appropriate wear resistance.

Optionally, the homogeneous material comprises carbides within the range of 3-6 vol %.

Optionally, the homogeneous material comprises nitrides and/or carbonitrides in the range of 12-25 vol %, preferably in the range of 14-20 vol %.

Optionally, an average size of the nitrides is within the range of 1-3 μm. An average nitride size within the above range implies a preferred machinability.

Optionally, at least 10 vol %, preferably at least 12 vol %, more preferred at least 15 vol %, of the nitrides consists of vanadium nitrides. A vanadium nitride amount at or above any one of the above limit implies an appropriate wear resistance.

Optionally, the homogeneous material consists of 0.6-1.6 weight % C, 1.5-3 weight % N, 0.2-0.6 weight % Mn, 0.3-0.7 weight % Si, 4-5 weight % Cr, 2.8-3.6 weight % Mo, 3.4-4 weight % W, 8-10 weight % V, balance Fe.

Optionally, the homogeneous material consists of 0.95-1.25 weight % C, 1.5-2.1 weight % N, 0.3-0.5 weight % Mn, 0.4-0.6 weight % Si, 4.2-4.8 weight % Cr, 3-3.4 weight % Mo, 3.5-3.9 weight % W, 8.2-8.8 weight % V, balance Fe.

A second aspect of the present disclosure relates to an internal combustion engine comprising a valve seat insert according to the first aspect of the present disclosure.

A third aspect of the present disclosure relates to a vehicle, preferably a heavy-duty vehicle i.e. a vehicle having a gross vehicle weight rating (GVWR) of 11 000 kg or more, comprising an internal combustion engine according to the second aspect of the present disclosure.

A fourth aspect of the present disclosure relates to a method for manufacturing a valve seat insert for an internal combustion engine. The method comprises:

arranging nitrided steel powder in a mould, and densifying the nitrided steel powder.

Optionally, the nitrided steel powder has a nitrogen content of at least 0.5 weight %, preferably at least 1.0 weight %, more preferred at least 1.5 weight %.

Optionally, the nitrided steel powder consists of 0.6-1.6 weight % C, 1.5-3 weight % N, 0.2-0.6 weight % Mn, 0.3-0.7 weight % Si, 4-5 weight % Cr, 2.8-3.6 weight % Mo, 3.4-4 weight % W, 8-10 weight % V, balance Fe.

Optionally, the nitrided steel powder consists of 0.95-1.25 weight % C, 1.5-2.1 weight % N, 0.3-0.5 weight % Mn 0.4-0.6 weight % Si, 4.2-4.8 weight % Cr, 3-3.4 weight % Mo, 3.5-3.9 weight % W, 8.2-8.8 weight % V, balance Fe.

Optionally, the nitrided steel powder is densified by high velocity compaction, preferably at room temperature, to form a high velocity compacted part.

Optionally, the high velocity compacted part is sintered at a temperature exceeding 1100° C. preferably exceeding 1200° C.

Optionally, the nitrided steel powder is densified by hot isostatic pressing.

Optionally, the hot isostatic pressing is performed at a temperature exceeding 1100° C., preferably exceeding 1200° C.

Optionally, the hot isostatic pressing is performed at a pressure in the range of 100 to 350 MPa.

BRIEF DESCRIPTION OF THE DRAWINGS

With reference to the appended drawings, below follows a more detailed description of embodiments of the invention cited as examples.

In the drawings.

It should be noted that the appended drawings are not necessarily drawn to scale and that the dimensions of some features of the present invention may have been exaggerated for the sake of clarity.

DETAILED DESCRIPTION

The invention will below be described for a vehicle in the form of a truck 1 such as the one illustrated in FIG. 1. The truck 1 should be seen as an example of a vehicle which could comprise a valve seat insert and/or an internal combustion engine according to the present invention. However, the valve seat insert and/or an internal combustion engine of the present invention may be implemented in a plurality of different types of objects, e.g. other types of vehicles. Purely by way of example, the valve seat insert and/or an internal combustion engine could be implemented in a truck, a tractor, a car, a bus, a work machine such as a wheel loader or an articulated hauler or any other type of construction equipment. The truck 1 comprises an internal combustion engine 10.

Figure 1:
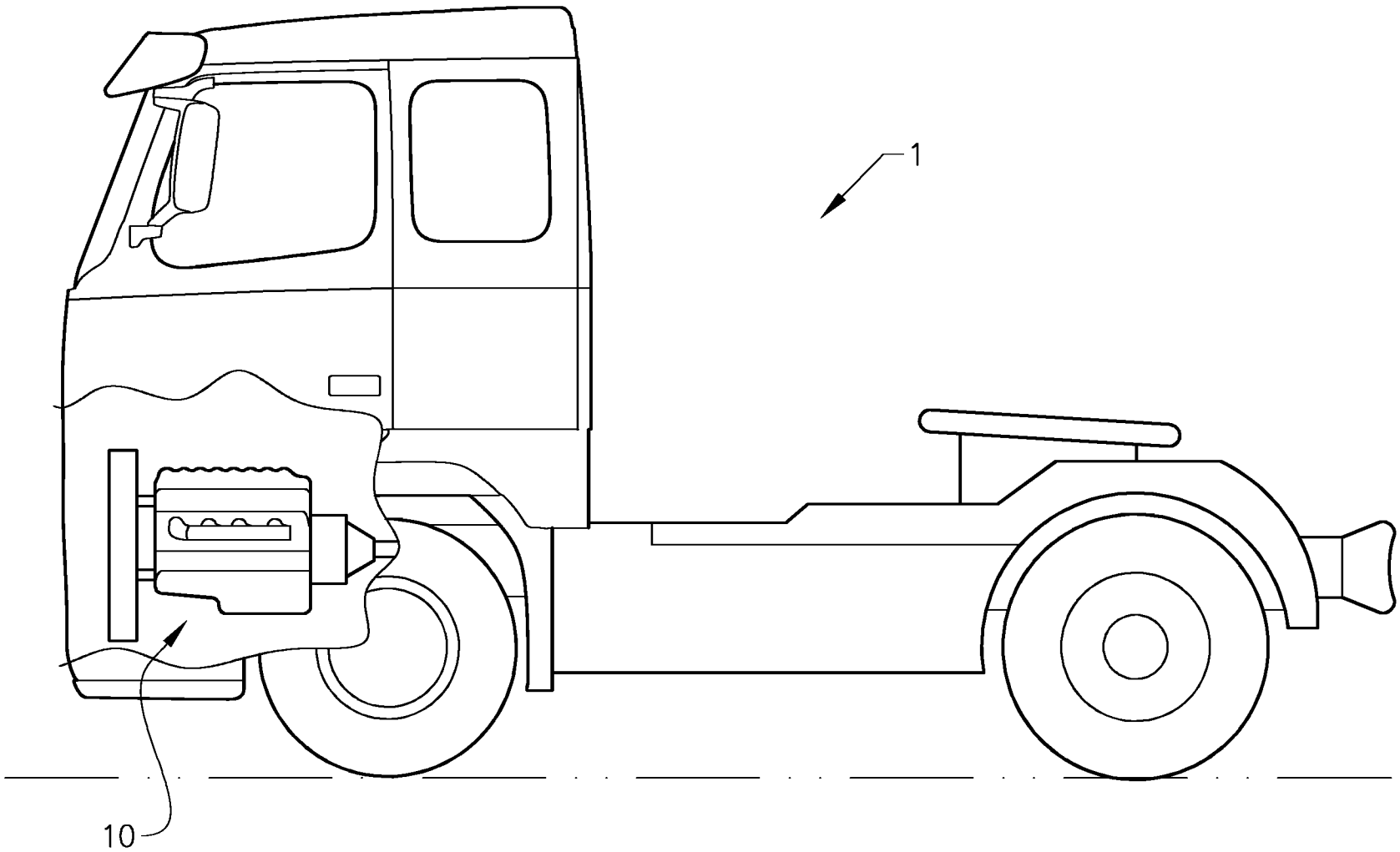
FIG. 1 illustrates a truck comprising an internal combustion engine.
Figure 2:
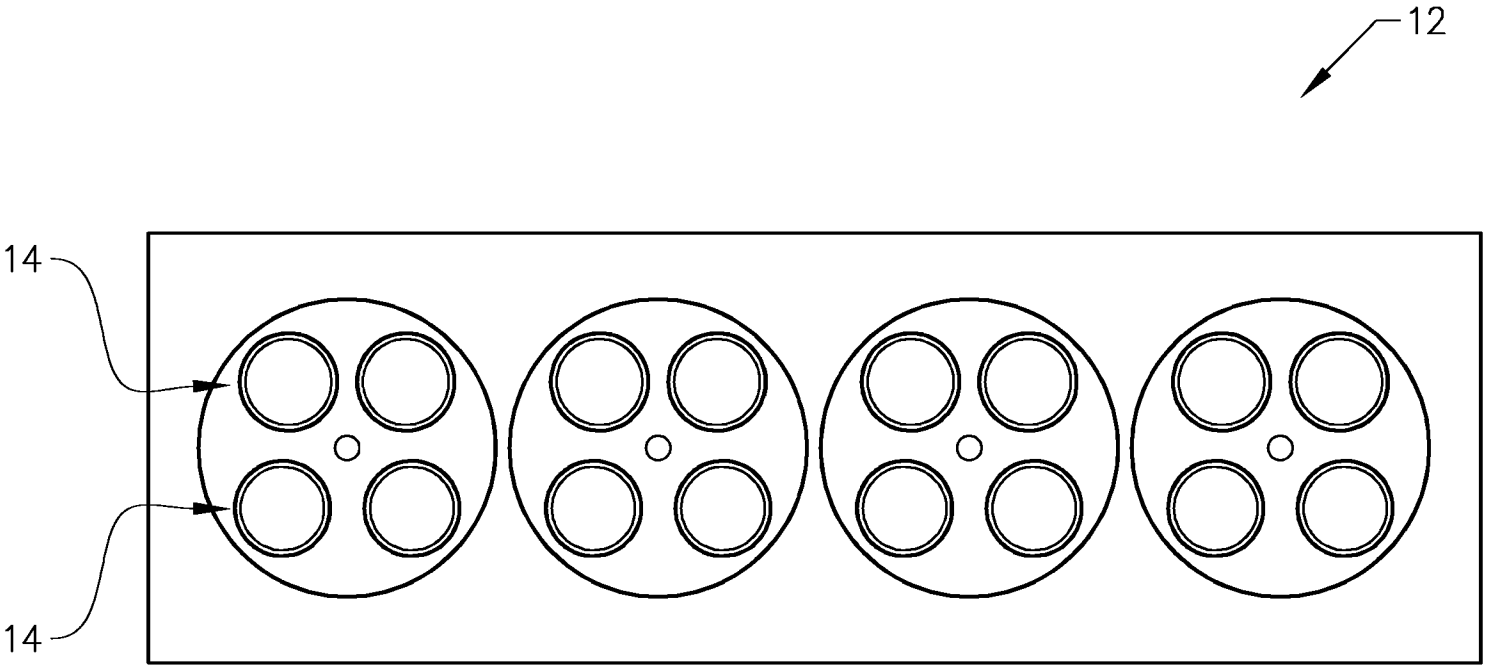
FIG. 2 schematically illustrates a bottom view of a cylinder head that comprises a plurality of valve seat inserts.

FIG. 2 is a bottom view of a cylinder head 12 of an internal combustion engine, such as the internal combustion engine 10 illustrated in FIG. 1. As may be gleaned from FIG. 2, a plurality of valve seat inserts 14 are attached to the cylinder head 12. Purely by way of example, each one of the valve seat inserts 14 may be press-fitted into a corresponding opening of the cylinder head 12. However, it is also envisaged that a valve seat insert 14 instead of, or in addition to, being press fitted is connected to the cylinder head 12 in another way, such as shrink-fitting, welding, gluing or the like.

Figure 3:
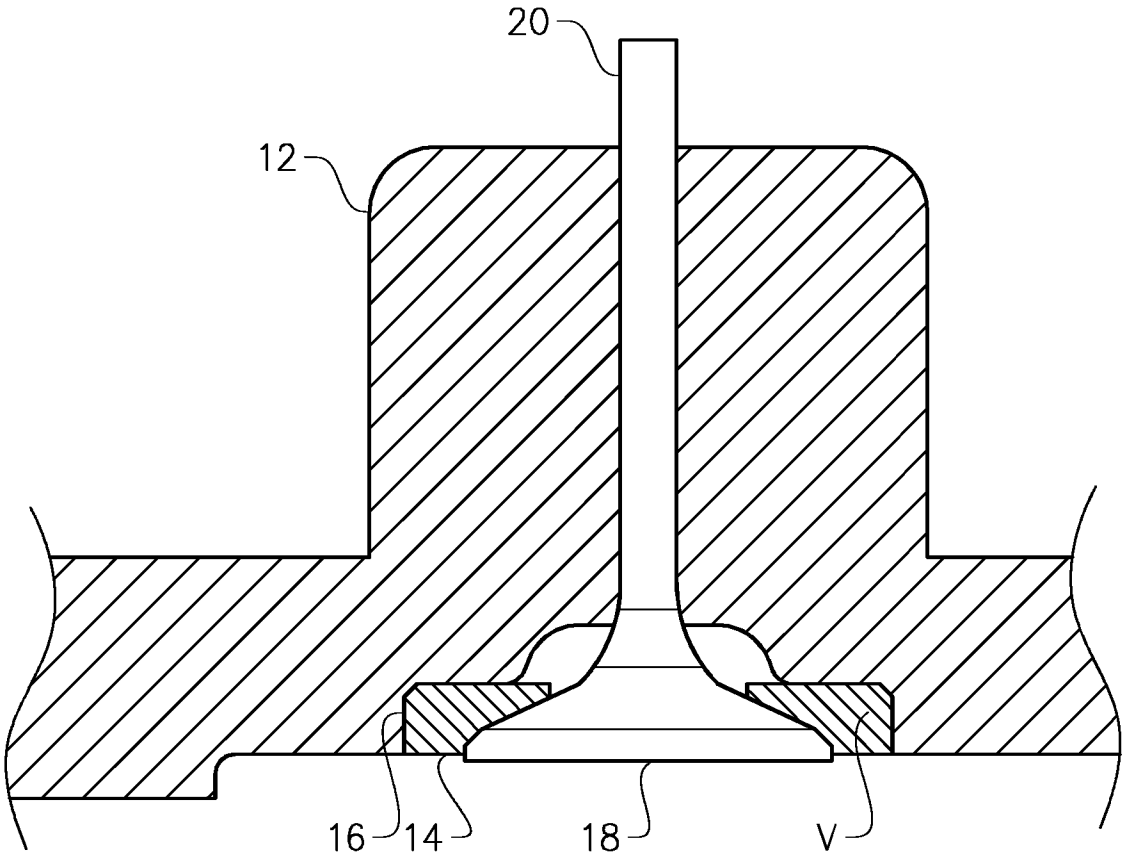
FIG. 3 schematically illustrates a valve seat insert that has been inserted into a cylinder bead.

FIG. 3 illustrates an embodiment of a valve seat insert 14. The FIG. 3 valve seat insert 14 is suitable for an internal combustion engine, such as the internal combustion engine 10 of the type illustrated in FIG. 1. Moreover, though purely by way of example, the FIG. 3 valve seat insert 14 may be suitable for being inserted into a cylinder head, such as the cylinder head 12 illustrated in FIG. 2.

FIG. 3 further illustrates that a first portion 16 of the valve seat insert 18 is adapted to contact a cylinder head 12 and a second portion 18 of the valve seat insert 14 is adapted to contact a valve 20. The valve seat insert has a valve seat insert volume V.

According to the invention, a major part of the valve seat insert volume V consists of a homogeneous material that comprises nitrides.

Purely by way of example, at least 80 vol %, alternatively at least 90 vol %, preferably at least 95 vol %, more preferred at least 98 vol %, of the valve seat insert consists of the homogeneous material. As a non-limiting example, the valve seat insert 14 may be an integral component that consists substantially completely, i.e. save for impurities or the like, of the homogeneous material. Alternatively, the valve seat insert 14 may be a separate component that is constituted by one or more parts.

The homogeneous material may comprise at least 5 vol %, preferably at least 10 vol %, more preferred at least 15 vol %, of nitrides.

Moreover, in addition to nitrides, the homogeneous material may comprise at least 3 vol % of carbides, alternatively carbides within the range of 3-6 vol %.

The amount of nitrides and/or carbonitrides M (N,C) may be in the range of 12-25 vol % for the proposed alloy, with a preferred value being approximately 15 vol %. The amount of carbides M(C) may be 3-6 vol %, with a preferred value being 5 vol % for the proposed alloy. As used above, "M" stands for metallic component of the carbides, carbonitride or nitride, and may be constituted by several of the metallic elements of the alloy.

As another non-limiting example, the homogeneous material may comprise nitrides and/or carbonitrides in the range of 12-25 vol %, preferably in the range of 14-20 vol %.

Purely by way of example, an average size of the nitrides is within the range of 1-3 μm. An average nitride size within the above range implies a preferred machinability.

Purely by way of example, the size of the nitrides can be measured from an image of a cross-section of the homogeneous material, which image has a magnification of for instance 3000-5000 times, taken with e.g. a scanning electron microscope equipped with a back-scatter detector. The nitride size may be determine by determining the diameter of the smallest circle that envelopes the nitride. Moreover, the volume fraction of nitrides/carbonitrides/carbides can be calculated based on the image.

As a non-limiting example, at least 10 vol %, preferably at least 12 vol %, more preferred at least 15 vol %, of the nitrides consists of vanadium nitrides. A vanadium nitride amount at or above any one of the above limit implies an appropriate wear resistance. Preferably, nitrides and/or carbonitrides of the homogeneous material are vanadium-rich with a chemistry close to the nitride of type MN (where M=Vanadium and N=Nitrogen).

Purely by way of example, the homogeneous material may consist of 0.6-1.6 weight % C, 1.5-3 weight % N, 0.2-0.6 weight % Mn, 0.3-0.7 weight % Si, 4-5 weight % Cr, 2.8-3.6 weight % Mo, 3.4-4 weight % W, 8-10 weight % V, balance Fe.

As another non-limiting example, the homogeneous material may consists of 0.95-1.25 weight % C, 1.5-2.1 weight % N, 0.3-0.5 weight % Mn, 0.4-0.6 weight % Si, 4.2-4.8 weight % Cr, 3-3.4 weight % Mo, 3.5-3.9 weight % W, 8.2-8.8 weight % V, balance Fe.

For example, the homogeneous material may consists of 1.1 weight % C, 1.8 weight % N, 0.4 weight % Mn, 0.5 weight % Si, 4.5 weight % Cr, 3.2 weight % M, 3.7 weight % W, 8.5 weight % V, balance Fe and unavoidable impurities.

Figure 4:
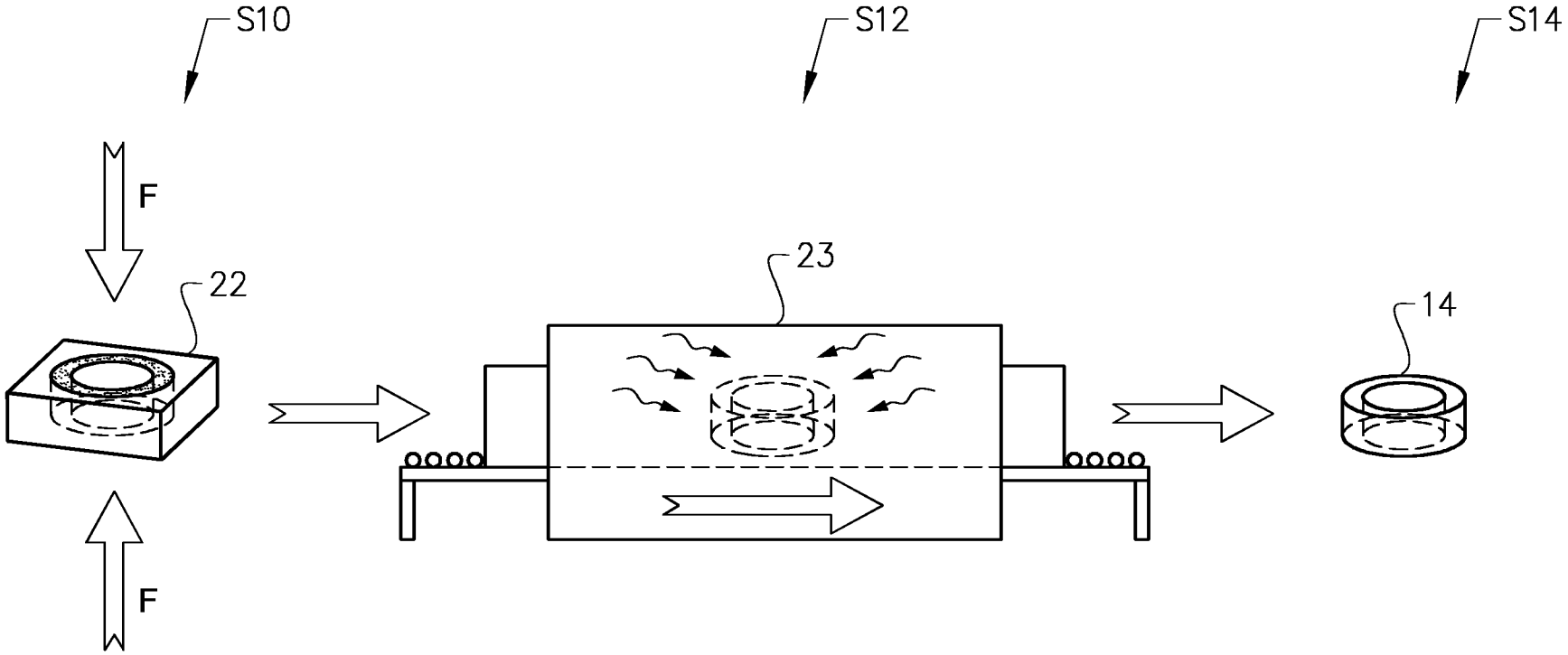
FIG. 4 schematically illustrates an embodiment of a high velocity compaction method for producing a valve seat insert.
Figure 5:
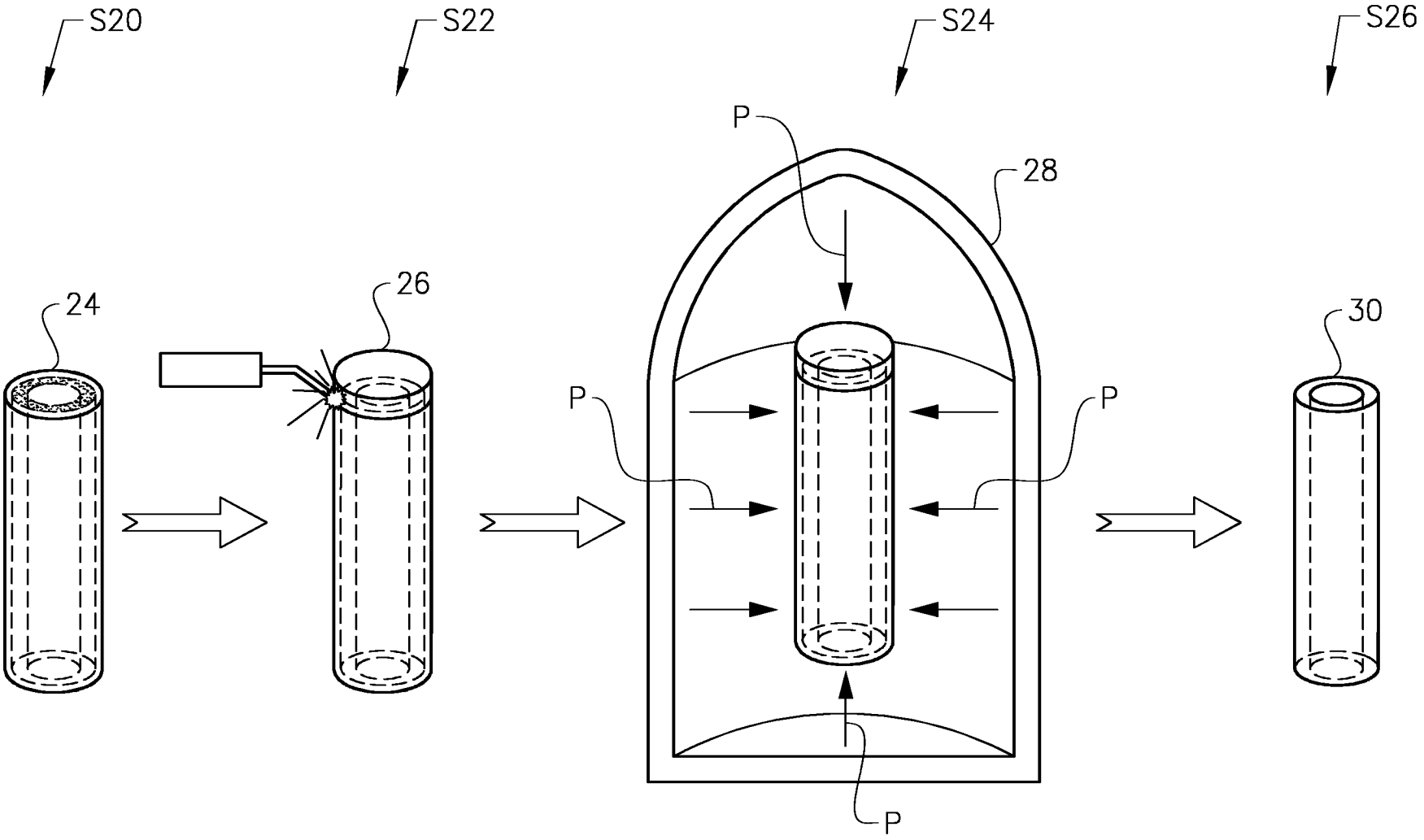
FIG. 5 schematically illustrates an embodiment of a hot isostatic pressing method for producing a valve seat insert, and FIG. 6 schematically illustrates an embodiment of a method for producing a nitrided steel powder.

FIG. 4 and FIG. 5 illustrate embodiments of a method for manufacturing a valve seat insert for an internal combustion engine. The inventive method comprises:

arranging nitrided steel powder in a mould, and densifying the nitrided steel powder.

Purely by way of example, the nitrided steel powder may have a nitrogen content of at least 0.5 weight %, preferably at least 1.0 weight %, more preferred at least 1.5 weight %.

As a non-limiting example, the nitrided steel powder may consist of 0.6-1.6 weight % C, 1.5-3 weight % N, 0.2-0.6 weight % Mn, 0.3-0.7 weight % Si, 4-5 weight % Cr, 2.8-3.6 weight % Mo, 3.4-4 weight % W, 8-10 weight % V, balance Fe.

Alternatively, the nitrided steel powder may consist of 0.95-1.25 weight % C, 1.5-2.1 weight % N, 0.3-0.5 weight % Mn, 0.4-0.6 weight % Si, 4.2-4.8 weight % Cr, 3-3.4 weight % Mo, 3.5-3.9 weight % W, 8.2-8.8 weight % V, balance Fe.

For example, the nitrided steel powder may consists of 1.1 weight % C, 1.8 weight % N, 0.4 weight % Mn, 0.5 weight % Si, 4.5 weight % Cr, 3.2 weight % Mo, 3.7 weight % W, 8.5 weight % V, balance Fe and unavoidable impurities.

FIG. 4 illustrates an embodiment of the valve seat insert manufacturing method in which the nitrided steel powder is densified by high velocity compaction. As such, in a first step S10 in the FIG. 4 method, the nitrided steel powder arranged in a mould 22. The powder in the mould 22 is then compacted at high velocity to thereby form a high velocity compacted part. As a non-limiting example, the powder may be compacted at an impact speed of at least 5 m/s. However, it is also envisaged that embodiments of the valve seat insert manufacturing method may employ even higher speeds. Purely by way of example, in embodiments of the method, the speed may exceed 50 m/s or even 80 m/s.

In a second step S12, the high velocity compacted part is sintered in controlled atmosphere. Purely by way of example, the high velocity compacted part may be sintered at a temperature exceeding 1100° C., preferably at a temperature exceeding 1200° C., for instance in a sintering oven 23 in a vacuum or in a reducing or inert atmosphere. Thereafter, in a third step S14, the valve seat insert 14 is obtained. A high velocity compaction performed at or above any one of the above limits could contribute to an appropriate temperature stability during use.

As an alternative to the high velocity compaction illustrated in FIG. 4, the nitrified steel powder may be densified by hot isostatic pressing. FIG. 5 illustrates an embodiment of a hot isostatic pressing method. In the FIG. 5 method, in step S20, nitrided steel powder is placed inside a mould 24, e.g. a tubular mould. In step S22, the mould 24 is sealed, for instance by connecting a lid 26 to the mould 24 by means of welding. In step S24, the thus sealed mould 24 is subjected to hot isostatic pressing, i.e. the sealed mould 24 is subjected to an elevated temperature as well as an elevated pressure in a vessel 28. Purely by way of example, the high pressure may be obtained by feeding an inert gas, such as argon into the vessel 28. Moreover, at least the interior of the vessel 28 is heated.

As non-limiting examples, the pressure in the vessel may be in the range of 100 to 350 MPa. Moreover, again as a non-limiting example, the temperature in the vessel may exceed 1100° C. and may preferably exceed 1200° C. Purely by way of example, the temperature may be in the range of 1000-1500° C., alternatively in the range of 1200-1300° C.

Subsequent to the hot isostatic pressing, in step S26, the mould 24 and the lid 26 are removed such that a blank 30 for valve seat insert is obtained. Such a blank 30 can thereafter be cut in order to obtain individual valve seat inserts (not shown in FIG. 5).

Figure 6:
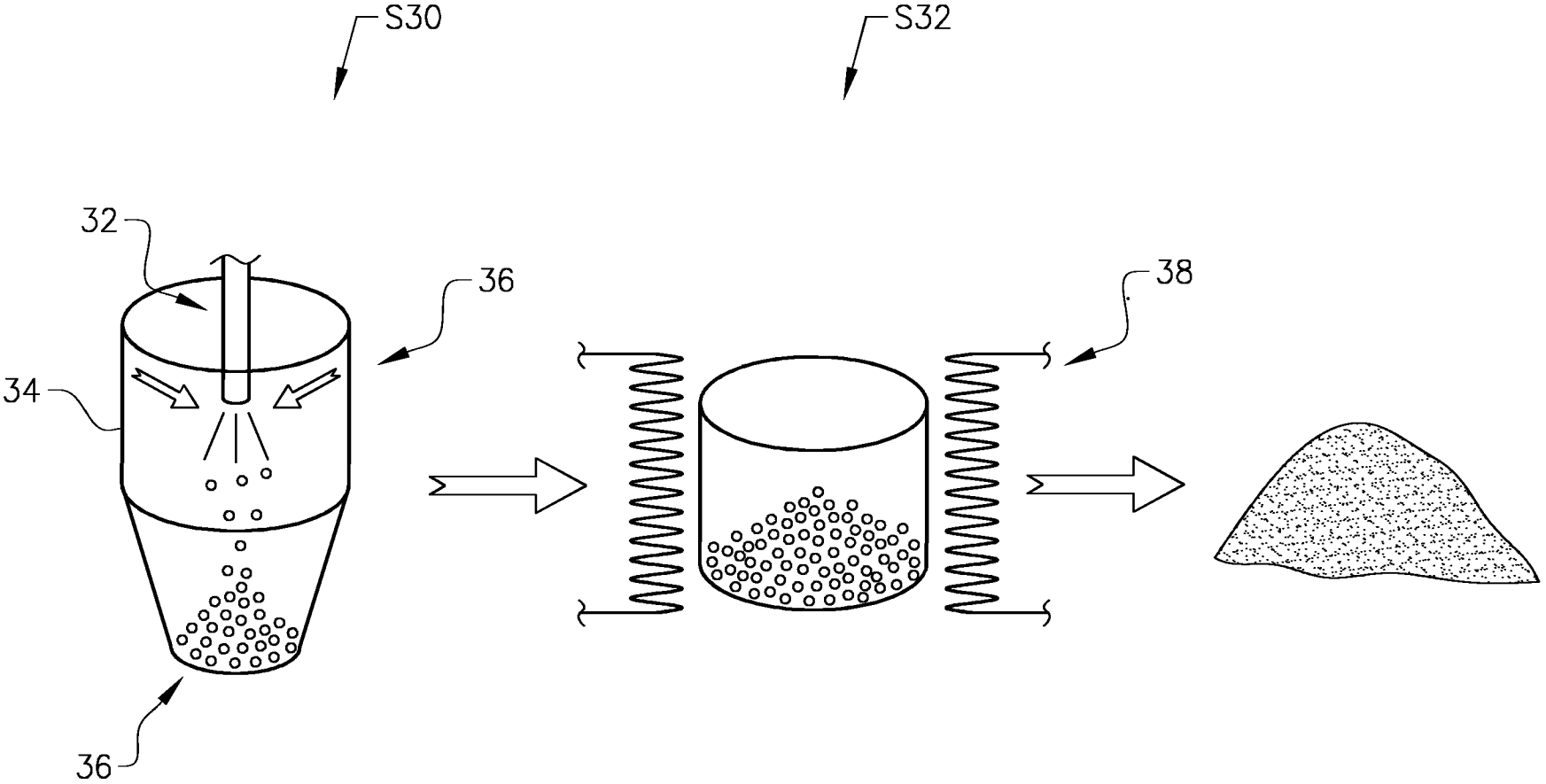

Finally, FIG. 6 illustrates a method for producing a nitrided steel powder. Purely by way of example, the nitrided steel powder produced in the FIG. 6 method may be used in either one of the methods for manufacturing a valve seat insert which have been described hereinabove with reference to FIG. 4 and FIG. 5, respectively. In step S30 in FIG. 6, liquid steel 32 is poured into, a container 34. Adjacent to the liquid steel 32, nitrogen 36 is discharged, preferably at a high pressure. In the container 34, steel droplets are formed that fall to the bottom of the container 34 as metal powder 36.

The metal powder 36 obtained in step 30 is thereafter nitrided. Purely by way of example, and as is indicated in step S32 the metal powder 36 may be nitrided in a bed reactor 38 at a temperature within the range of 550-600° C. During step S32, nitrogen and ammonia may be fed to the bed reactor 38.

It is to be understood that the present invention is not limited to the embodiments described above and illustrated in the drawings; rather, the skilled person will recognize that many changes and modifications may be made.

The invention claimed is:

1. A valve seat insert for an internal combustion engine, a first portion of the valve seat insert being adapted to contact a cylinder head and a second portion of the valve seat insert being adapted to contact a valve, the valve seat insert having a valve seat insert volume a major part of the valve seat insert volume consists of a homogeneous material that comprises nitrides, wherein the homogeneous material comprises at least 5 vol % of nitrides and wherein at least 10 vol % of the nitrides consist of vanadium nitrides.

2. The valve seat insert according to claim 1, wherein at least 80 vol % of the valve seat insert consists of the homogeneous material.

3. The valve seat insert according to claim 1, wherein the homogeneous material comprises at least 10 vol % of carbides.

4. The valve seat insert according to claim 1, wherein the homogeneous material comprises at least 3 vol % of carbides.

5. The valve seat insert according to claim 4, wherein the homogeneous material comprises carbides within the range of 3-6 vol %.

6. The valve seat inset according to claim 1, wherein the homogeneous material comprises nitrides and/or carbonitrides in the range of 12-25 vol %.

7. The valve seat insert according to claim 1, wherein an average size of the nitrides is within the range of 1-3 μm.

8. The valve seat insert according to claim 1, wherein the homogeneous material consists of 0.6-1.6 weight % C, 1.5-3 weight % N, 0.2-0.6 weight % Mn, 0.3-0.7 weight % Si, 4-5 weight % Cr, 2.8-3.6 weight % Mo, 3.4-4 weight % W, 8-10 weight % V, balance Fe.

9. The valve seat insert according to claim 1, wherein the homogeneous material consists of 0.95-1.25 weight % C, 1.5-2.1 weight % N, 0.3-0.5 weight % Mn, 0.4-0.6 weight % Si, 4.2-4.8 weight % Cr, 3-3.4 weight % Mo, 3.5-3.9 weight % W, 8.2-8.8 weight %, V, balance Fe.

10. An internal combustion engine comprising a valve seat insert according to claim 1.

11. A vehicle comprising an internal combustion engine according to claim 10.

12. A method for manufacturing a valve seat insert for an internal combustion engine, comprising: arranging nitrided steel powder in a mould, and densifying the nitrided steel powder, wherein the nitrided steel powder has a nitrogen content of at least 0.5 weight %.

13. The method according to claim 12, wherein the nitrided steel powder has a nitrogen content of at least 1.0 weight %.

14. The method according to any one of claim 12, wherein the nitrided steel powder consists of 0.6-1.6 weight % C, 1.5-3 weight % N, 0.2-0.6 weight % Mn, 0.3-0.7 weight % Si, 4-5 weight % Cr, 2.8-3.6 weight % Mo, 3.4-4 weight % W, 8-10 weight % V, balance Fe.

15. The method according to claim 12, wherein the nitrided steel powder consists of 0.95-1.25 weight % C, 1.5-2.1 weight % N, 0.3-0.5 weight % Mn, 0.4-0.6 weight % Si, 4.2-4.8 weight % Cr, 3-3.4 weight % Mo, 3.5-3.9 weight % W, 8.2-8.8 weight % V, balance Fe.

16. The method according to claim 12, wherein the nitrided steel powder is densified by high velocity compaction to form a high velocity compacted part.

17. The method according to claim 16, wherein the high velocity compacted part is sintered at a temperature exceeding 1100° C.

18. The method according to claim 12, wherein the nitrided steel powder is densified by hot isostatic pressing.

19. The method according to claim 18, wherein the hot isostatic pressing is performed at a temperature exceeding 1100° C.

20. The method according to claim 18, wherein the hot isostatic pressing is performed at a pressure in the range of 100 to 350 MPa.

* * * * *